US008307766B2

(12) United States Patent
Marx

(10) Patent No.: US 8,307,766 B2
(45) Date of Patent: Nov. 13, 2012

(54) DRAG EFFECT TRAJECTORY ENHANCED PROJECTILE

(75) Inventor: PJ Marx, Sarasota, FL (US)

(73) Assignee: Liberty Ammunition, Inc., Clearwater, FL (US)

( * ) Notice: Subject to any disclaimer, the term of this patent is extended or adjusted under 35 U.S.C. 154(b) by 205 days.

(21) Appl. No.: 12/784,664

(22) Filed: May 21, 2010

(65) Prior Publication Data

US 2011/0259231 A1 Oct. 27, 2011

Related U.S. Application Data

(60) Provisional application No. 61/326,823, filed on Apr. 22, 2010.

(51) Int. Cl.
*F42B 5/02* (2006.01)
*F42B 30/02* (2006.01)

(52) U.S. Cl. ..... 102/439; 102/501

(58) Field of Classification Search ..... 102/501, 102/507, 508, 439, 498, 509, 529; D22/116
See application file for complete search history.

(56) References Cited

U.S. PATENT DOCUMENTS

| | | | | |
|---|---|---|---|---|
| 594,199 | A | 11/1897 | Field | |
| 1,141,212 | A | 6/1915 | Ross | |
| 1,328,334 | A * | 1/1920 | Newton | 102/508 |
| 3,672,304 | A * | 6/1972 | Rogers et al. | 102/516 |
| 3,714,900 | A | 2/1973 | Feldmann | |
| 3,952,662 | A | 4/1976 | Greenlees | |
| 4,245,557 | A | 1/1981 | Knappworst et al. | |
| D271,609 | S * | 11/1983 | Brown | D22/116 |
| 4,572,077 | A * | 2/1986 | Antoine et al. | 102/439 |
| 4,742,776 | A * | 5/1988 | Scuto | 102/509 |
| 4,776,279 | A | 10/1988 | Pejsa | |
| 4,793,037 | A | 12/1988 | Carter | |
| 4,813,635 | A * | 3/1989 | Paterson et al. | 244/130 |

(Continued)

FOREIGN PATENT DOCUMENTS

GB 2279440 A * 1/1995

OTHER PUBLICATIONS

International Search Report with a date of mailing of May 5, 2011 for PCT/US2011/028074 with an International Filing Date of Mar. 11, 2011.

*Primary Examiner* — Bret Hayes
(74) *Attorney, Agent, or Firm* — Ronald E. Smith; Anton J. Hopen; Smith & Hopen, P.A.

(57) ABSTRACT

A projectile includes a cartridge and a hollow bullet. A propellant fills the cartridge and the hollow bullet to increase the velocity of the bullet when fired. The hollow bullet has a flattened leading end and an annular ring is secured to the flattened leading end in the center of the flat region. The flattened leading end and the annular ring move a center of pressure forwardly so that a center of pressure is forward of a center of gravity of the bullet when the bullet is in flight. In a second embodiment, a plurality of circumferentially spaced apart slits is formed in a trailing end of the hollow bullet, creating a plurality of circumferentially spaced apart fins that flare radially outwardly upon impact with a soft target.

6 Claims, 6 Drawing Sheets

U.S. PATENT DOCUMENTS

| | | | | |
|---|---|---|---|---|
| 4,964,341 | A * | 10/1990 | Hebert | 102/501 |
| 5,097,768 | A | 3/1992 | Petrovich | |
| 5,798,478 | A | 8/1998 | Beal | |
| 5,811,723 | A | 9/1998 | Stone | |
| 5,874,691 | A | 2/1999 | Manole et al. | |
| 6,182,574 | B1 | 2/2001 | Giannoni | |
| 6,240,849 | B1 | 6/2001 | Holler | |
| 6,257,146 | B1 * | 7/2001 | Stonebraker | 102/346 |
| 6,439,125 | B1 | 8/2002 | Carter | |
| 6,453,820 | B1 | 9/2002 | Anderson | |
| 6,805,057 | B2 | 10/2004 | Carr et al. | |
| D502,525 | S | 3/2005 | Benini et al. | |
| 6,959,648 | B2 | 11/2005 | Piela | |
| 6,964,232 | B2 | 11/2005 | Eberhart et al. | |
| 7,036,433 | B2 | 5/2006 | Beal | |
| 2002/0178963 | A1 | 12/2002 | Halverson | |
| 2004/0050284 | A1 | 3/2004 | Piela | |
| 2008/0047457 | A1 * | 2/2008 | Riess et al. | 102/501 |

* cited by examiner

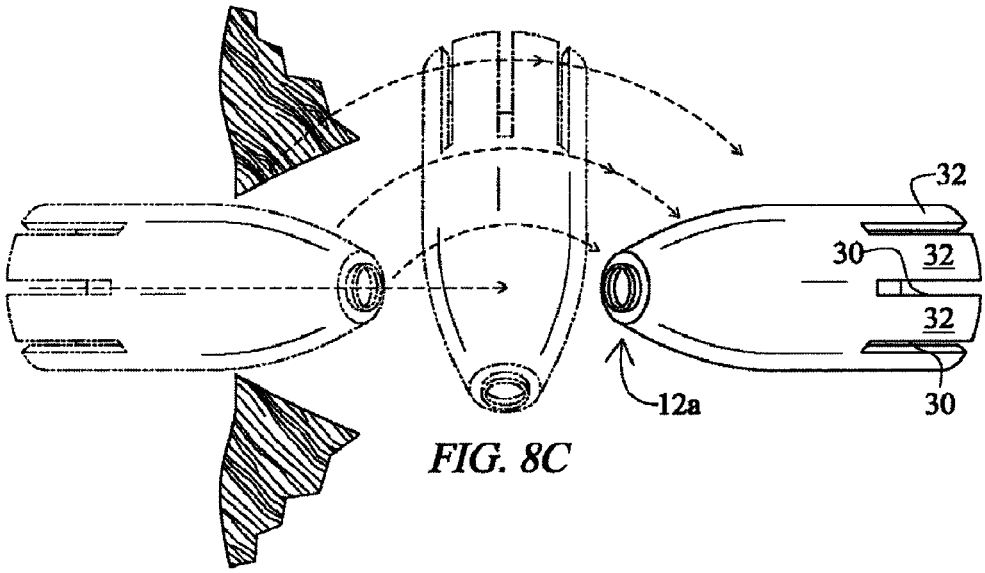
FIG. 8C
FIG. 8D
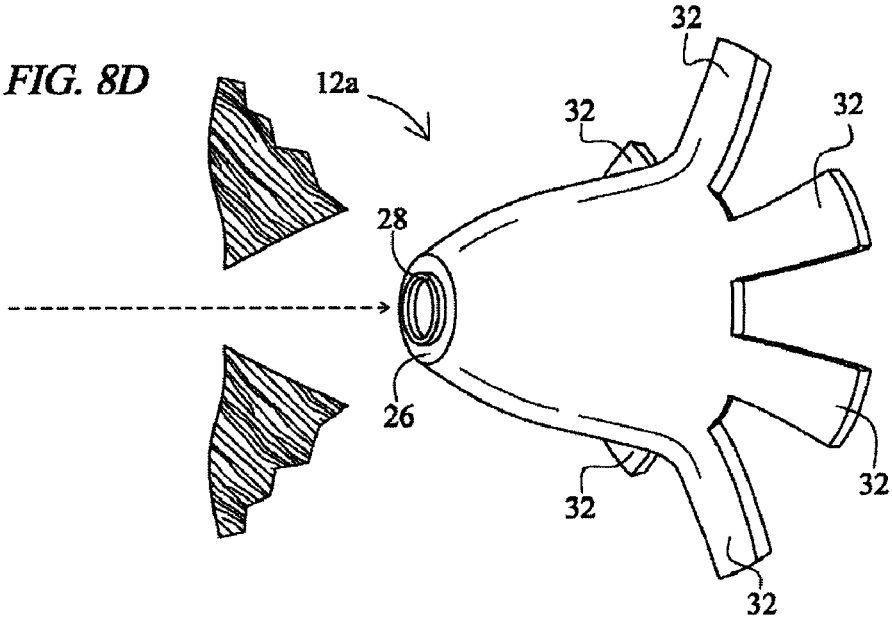

DRAG EFFECT TRAJECTORY ENHANCED PROJECTILE

CROSS-REFERENCE TO RELATED APPLICATIONS

This application claims priority to U.S. Provisional Patent Application No. 61/326,823, entitled: "Drag Effect Trajectory Enhanced Projectile," filed Apr. 22, 2010 by the same inventor, which application is hereby incorporated by reference into this application.

BACKGROUND OF THE INVENTION

1. Field of the Invention

This invention relates, generally, to the art of projectiles. More particularly, it relates to a projectile having a forward center of gravity that improves projectile performance.

2. Description of the Prior Art

For spin-stabilized projectiles, the center of pressure during projectile flight must lead the center of gravity of the projectile. The center of pressure is forward of the center of gravity during flight and moves rearwardly toward the center of gravity of the projectile due to increased projectile velocity. This limits the amount of charge that can be added to a projectile such as a bullet because if extra propellant is added to a cartridge to increase its velocity, thereby reducing the amount of lead in the bullet to make room for said increased propellant, the center of gravity of a projectile is moved forward because propellant is lighter in weight than lead, but the center of pressure is moved rearward due to increased projectile velocity.

Thus there is a need for a projectile having an increased amount of propellant so that it can achieve greater velocity but the needed projectile must have a center of pressure that leads the center of gravity.

However, in view of the art considered as a whole at the time the present invention was made, it was not obvious to those of ordinary skill in the art how such a projectile could be provided.

SUMMARY OF THE INVENTION

The long-standing but heretofore unfulfilled need for a high velocity projectile where a center of pressure leads the center of gravity during flight is now met by a new, useful, and non-obvious invention.

The inventive structure is a projectile having a cartridge and a bullet having a trailing end slideably disposed within the cartridge. Lead is removed from the bullet so that the bullet is hollow. A propellant fills the cartridge and the hollow interior of the bullet, thereby providing the bullet with more propellant and an increased velocity when fired.

The hollow bullet has a flattened leading end. The flattened leading end moves a center of pressure forwardly so that the center of pressure is forward of a center of gravity of the bullet when the bullet is in flight.

To further enhance the effect of moving the center of pressure forwardly on the bullet during flight even at high velocity, an annular ring is secured to the flattened leading end in centered relation thereto. The annular ring forms an annular projection that leads the flattened leading end. The flattened leading end and the annular ring secured thereto in centered relation thereto cooperate to move the center of pressure forwardly so that the center of pressure is forward of the center of gravity of the bullet when the bullet is in high velocity flight.

A second embodiment includes a plurality of circumferentially spaced apart openings or slits formed in a trailing end of the projectile. A plurality of circumferentially spaced apart fins is thereby formed in the trailing end of the projectile by the plurality of circumferentially spaced openings.

The openings or slits preferably have a rectangular configuration so that the fins have a rectangular configuration. The openings preferably have a longitudinal extent of about one-third the longitudinal extent of the bullet or other projectile.

An object of the invention is to provide a high velocity projectile having a range and accuracy that are undiminished by reason of the high velocity.

A more specific object is to provide a high velocity projectile that has a center of pressure that leads the center of gravity of the projectile during flight.

An advantage of the invention is that ullage within the propellant cavity is increased thereby providing room for expansion upon ignition and thus more controlled pressure upon firing.

Yet another advantage of the present invention is that the lower projectile mass induces less recoil on the firearm. This lessens wear on both on the firearm and fatigue on the shooter.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which:

FIG. 8C indicates how the second embodiment yaws after impact and rotates as it moves deeper into the soft target in a direction that is reversed or substantially reversed from its in flight position;

FIG. 8D indicates how the trailing end of the second embodiment flares outwardly as it enters deeply into soft tissue while positioned in said reversed position.

DETAILED DESCRIPTION OF THE PREFERRED EMBODIMENT

Figure 1:
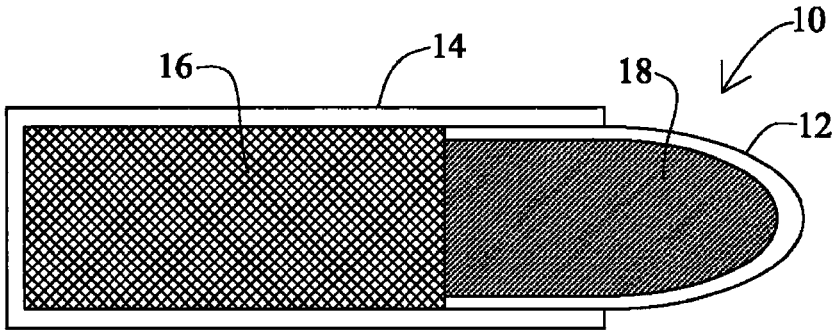
FIG. 1 PRIOR ART
FIG. 1 is a cross-sectional view of a prior art projectile seated in a cartridge.

A prior art projectile is denoted as a whole by the reference numeral 10 in FIG. 1.

Projectile 12 includes bullet 12 that is slideably mounted within cartridge 14. The part of cartridge 15 that is not occupied by the trailing end of bullet 12 filled with propellant 16. Bullet 12 is filled with lead 18.

Figure 2:
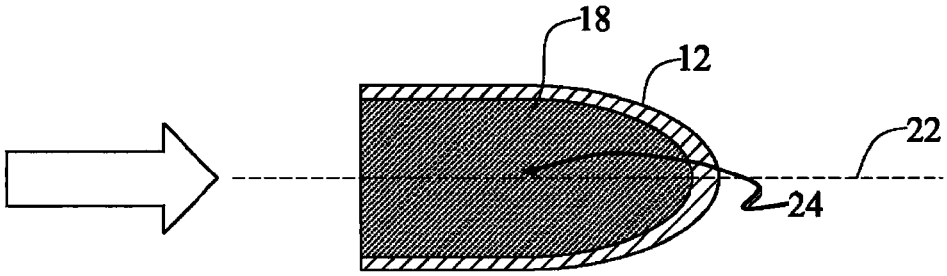
FIG. 2 PRIOR ART
FIG. 2 is a cross-sectional view of a prior art projectile in flight.

When bullet 12 is in flight, as indicated in FIG. 2 by a large directional arrow, its center of gravity is denoted 20. Dotted line 22 indicates the longitudinal axis of symmetry and the axis of rotation of said bullet 12 as it spins in the well-known way. The center of pressure 24 is forward of bullet 12.

If additional propellant is added to the prior art structure depicted in FIG. 1 to increase its velocity, center of pressure 24 in FIG. 2 will move toward center of gravity 20, causing projectile 10 to yaw or otherwise wobble, adversely affecting its range and accuracy.

Figure 3:
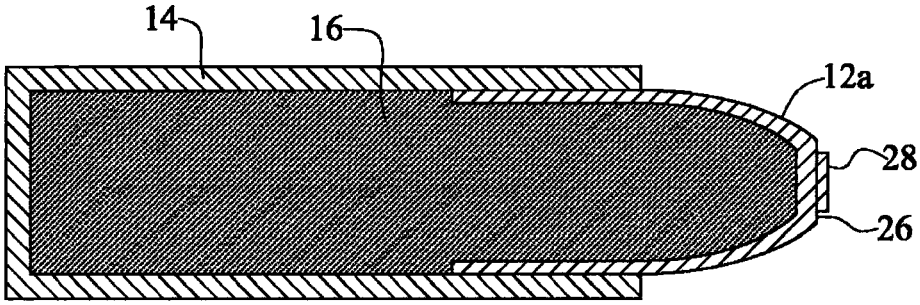
FIG. 3 is a cross-sectional view of the novel projectile seated in a cartridge.
Figure 4:
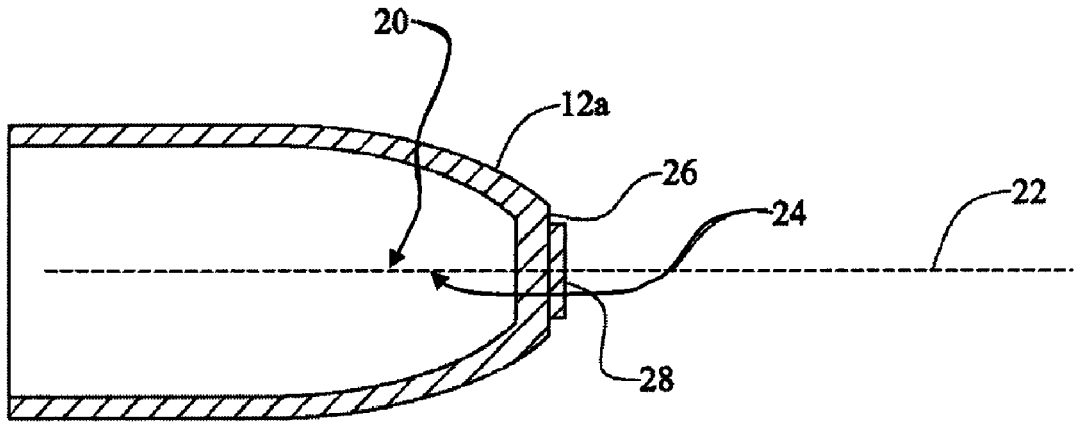
FIG. 4 is a cross-sectional view of the novel projectile in flight.

FIGS. 3 and 4 depict the highly novel solution to the problem that has long prevented projectile velocity increase. Projectile 12*a* in FIG. 3 is hollow instead of lead-filled. This enables propellant 16 to fill cartridge 14 as well as the hollow interior of projectile 12*a*. If a hollow prior art projectile is used in this manner, the extra propellant will increase projectile velocity to such an extent that center of pressure 24 will move rearwardly of center of gravity 20, thereby adversely affecting the range and accuracy of the projectile.

Figure 5:
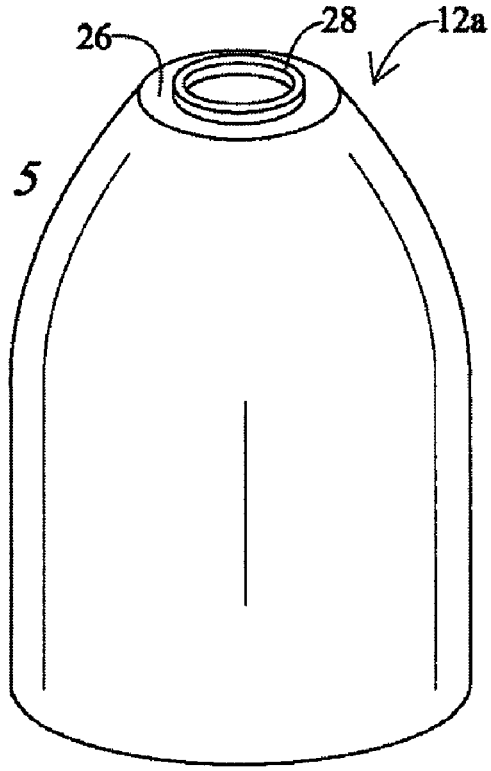
FIG. 5 is a perspective view of a first embodiment of the novel projectile.

As depicted in said FIGS. 3 and 4, the arcuate tip of projectile 12*a* is flattened as at 26 so that the standard ogive configuration of the projectile is eliminated. This moves center of pressure 24 somewhat forward of the point it would be at an increased velocity without said flattening. Moreover, annular ring 28 is mounted in centered relation to said flat area 26 as best depicted in FIGS. 5 and 6. This moves center of pressure 24 even further forward. The combined effect of the flattening and the provision of said annular ring is to move center of pressure 24 forward of the center of gravity even though center of gravity 20 is moved forwardly as depicted in FIG. 4 vis a vis the center of gravity of a lead-filled projectile.

In this way, increased velocity is achieved due to the greater propellant capacity even though the center of gravity of projectile 12*a* is moved forward. The center of pressure 24 is moved forward by the flattening of tip 12 and the centering of annular ring 26 in said flattened area.

Figure 6A:
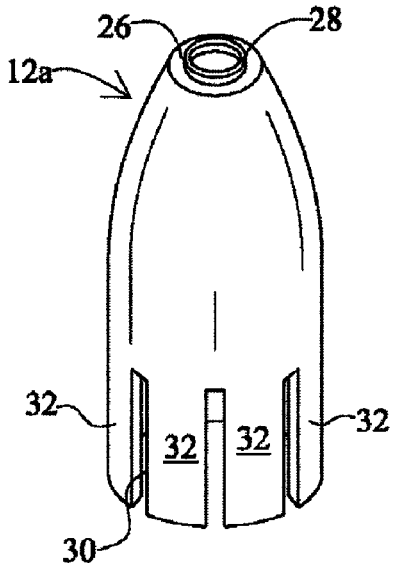
FIG. 6A is a perspective view of a second embodiment.
Figure 7:
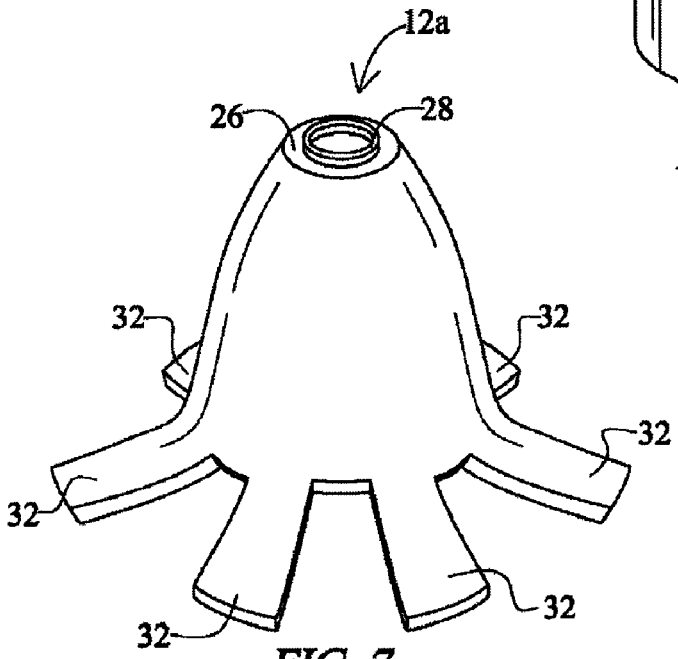
FIG. 7 is a perspective view of the second or third embodiment after impact and rotation within soft tissue.

FIG. 6A depicts a second embodiment where a plurality of longitudinally extending rectangular openings, collectively denoted 30, is formed in the trailing end or sidewall of novel projectile 12*a*. Openings 30 are circumferentially and equidistantly spaced apart from one another and therefore create a plurality of circumferentially and equidistantly spaced apart rectangular fins 32 that flare radially outwardly as depicted in FIG. 7 after entering into a soft target.

Figure 6B:
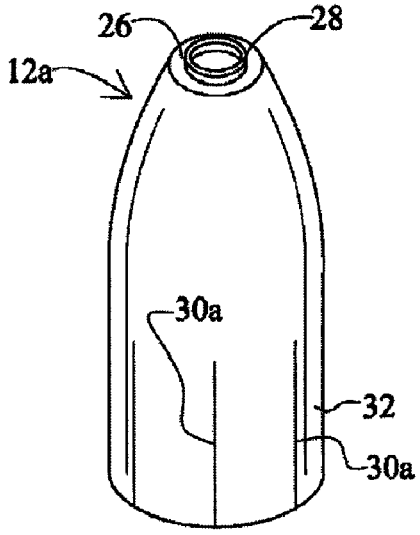
FIG. 6B is a perspective view of a third embodiment.

FIG. 6B depicts a third embodiment where slits 30 are replaced by scoring lines 30 that weaken the structure of the projectile. The projectile of FIG. 6B performs in substantially the same way as the projectile of FIG. 6A. More particularly, the projectile of FIG. 6B includes a plurality of circumferentially spaced apart weakening lines formed in a trailing end of the projectile. The weakening lines define a plurality of contiguous fins, each fin being flanked by a pair of said weakening lines. The projectile is weakened at each of the weakening lines so that individual fins are created when the projectile enters a soft target and yaws until contiguous fins separate from one another along the weakening lines and deploy radially outwardly relative to a longitudinal axis of symmetry of the projectile.

Openings or slits 30 have a longitudinal extent of about one-third the longitudinal extent of bullet 12*a*.

Figure 8A:
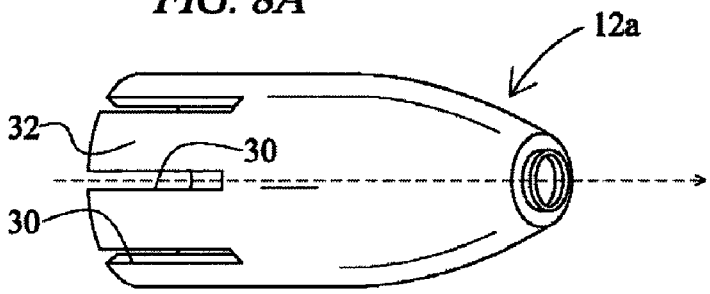
FIG. 8A depicts the second embodiment in flight.
Figure 8B:
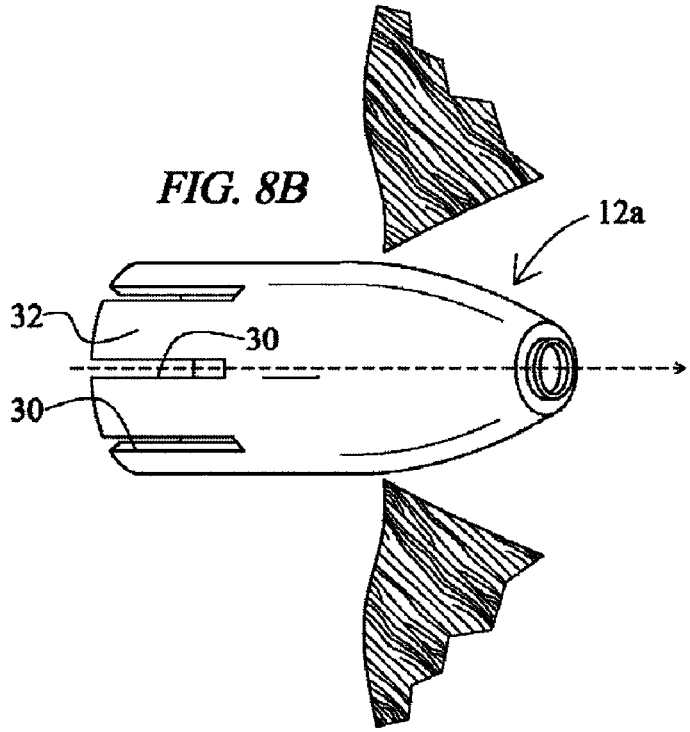
FIG. 8B depicts the second embodiment at the moment of impact with a soft target.
Figure 9:
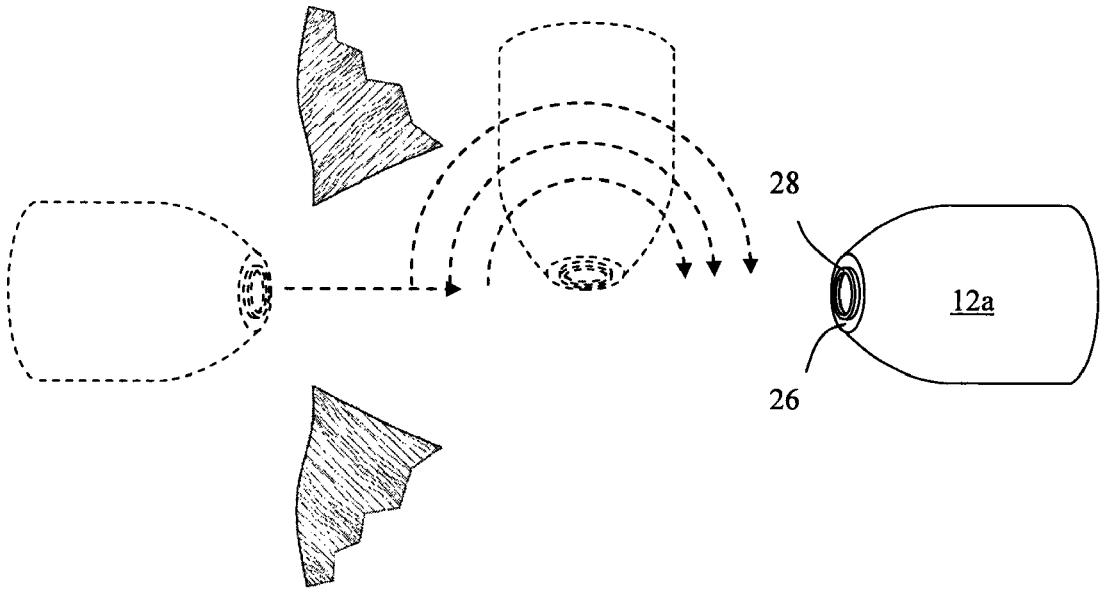
FIG. 9 indicates how the first embodiment yaws after impact and rotates as it moves deeper into the soft target in a direction that is reversed or substantially reversed from its in flight position.

FIG. 8A depicts the second embodiment in flight. FIG. 8B depicts the second embodiment at about the moment of impact with a soft target. FIG. 9 and FIG. 8C indicate how the first and second embodiments respectively yaw after impact and rotate as they penetrate deeper into the soft target in a direction that is reversed or substantially reversed from their in flight position. FIG. 8D indicates how the trailing end of the second embodiment flares outwardly as it enters deeply into soft tissue while positioned in said reversed position. The third embodiment of FIG. 6B operates in substantially the same way.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A round of ammunition, comprising:

a cartridge having a predetermined longitudinal extent;

a projectile having a predetermined longitudinal extent that exceeds the predetermined longitudinal extent of said cartridge, said projectile having a trailing end slideably disposed within said cartridge;

said cartridge and said projectile sharing a common longitudinal axis of symmetry;

said projectile having a hollow interior;

said projectile having a predetermined center of gravity coincident with said longitudinal axis of symmetry;

said projectile having a center of pressure coincident with said longitudinal axis of symmetry, said center or pressure created when said projectile is in flight;

a propellant filling said cartridge and said hollow interior, said propellant filling said cartridge being in open communication with said propellant filling said hollow interior;

said projectile having a flat leading end;

an annular ring secured to said flat leading end in concentric relation to said longitudinal axis of symmetry;

said flat leading end and said annular ring moving said center of pressure forwardly so that said center of pressure is forward of said center of gravity when said projectile is in flight.

2. The round of claim 1, further comprising:

a plurality of circumferentially spaced apart slits formed in said trailing end of said projectile;

a plurality of circumferentially spaced apart fins formed in said trailing end of said projectile by said plurality of circumferentially spaced slits.

3. The round of claim 2, further comprising:

said slits of said plurality of slits having a straight configuration so that said fins have a rectangular configuration.

4. The round of claim 3, further comprising:

said slits having a longitudinal extent of about one-third of said predetermined longitudinal extent of said projectile.

5. The round of claim 1, further comprising:

a plurality of circumferentially spaced apart weakening lines formed in said trailing end of said projectile;

a plurality of contiguous fins, each fin of said plurality of contiguous fins being positioned between a pair of said weakening lines;

each fin of said plurality of contiguous fins having a deployed configuration and an undeployed configuration;

each fin of said plurality of contiguous fins being substantially parallel to said longitudinal axis of symmetry when in its undeployed configuration; and each fin of said plurality of contiguous fins being oblique to said longitudinal axis of symmetry when said projectile has entered a soft target.

6. The round of claim 5, further comprising:

said weakening lines having a longitudinal extent of about one-third of said predetermined longitudinal extent of said projectile.

* * * * *